US007729649B2

(12) United States Patent
Horrall et al.

(10) Patent No.: US 7,729,649 B2
(45) Date of Patent: Jun. 1, 2010

(54) METHODS AND DEVICES FOR REDUCING WEAR ON A PRINT CARTRIDGE

(75) Inventors: Paul Douglas Horrall, Lexington, KY (US); Franklin Joseph Palumbo, Nicholasville, KY (US); Jarrett C. Gayne, Lexington, KY (US); Stacy Marie Pargett, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 797 days.

(21) Appl. No.: 11/384,531

(22) Filed: Mar. 20, 2006

(65) Prior Publication Data

US 2007/0217828 A1 Sep. 20, 2007

(51) Int. Cl.
*G03G 15/01* (2006.01)

(52) U.S. Cl. ..... 399/299

(58) Field of Classification Search ..... 399/299
See application file for complete search history.

(56) References Cited

U.S. PATENT DOCUMENTS 4,816,869 A 3/1989 Kasai et al.
4,952,978 A 8/1990 Ueda et al.
5,150,164 A 9/1992 Shea
5,159,393 A 10/1992 Hiroshima et al.
5,313,252 A 5/1994 Castelli et al.
5,508,789 A 4/1996 Castelli et al.
5,515,154 A 5/1996 Hasegawa et al.
5,523,829 A 6/1996 Miyashiro et al.
5,742,888 A 4/1998 Fuchiwaki et al.
5,781,826 A 7/1998 Inomata
6,560,433 B1 5/2003 Yamakama
6,701,109 B2 3/2004 Yoda et al.
6,724,161 B2 4/2004 Ueda et al.
6,741,823 B2 5/2004 Yamakama
6,766,124 B2 7/2004 Taguchi et al.

FOREIGN PATENT DOCUMENTS

JP 05066645 A * 3/1993
JP 2004233952 A * 8/2004

* cited by examiner

*Primary Examiner*—David M Gray
*Assistant Examiner*—Erika Villaluna

(57) ABSTRACT

A system and method reduces wear on an image-forming device. The image-forming device includes one or more toner cartridges, each having an associated PC drum and transport member to transport toner images or media. Each of the PC drums maintain contact with a surface of the transport member regardless of whether they are being used to form a toner image. A controller controls the rotation of the PC drums to rotate or not rotate while in contact with the surface of the transport member.

23 Claims, 6 Drawing Sheets

METHODS AND DEVICES FOR REDUCING WEAR ON A PRINT CARTRIDGE

BACKGROUND

The present application relates generally to image-forming devices, and more particularly to systems and methods of reducing wear on one or more toner cartridges included in the image-forming device.

Typical image-forming devices, such as printers and copiers, use photoconductive (PC) drums to transfer a toner image to a moving transport member such as an intermediate transfer member (ITM). Normally, the PC drums maintain contact with the surface of the ITM while continuously rotating to transfer the toner image. This continuous rotation occurs even for those PC drums associated with a particular color not being used in the formation of some images. For example, color toners are not utilized during the formation of a black and white image. The continuous rotation wears the PC drum surfaces at an increased rate, which reduces their useful lifespan. Additionally, the rotation continuously stirs the toner within the toner reservoir, which tends to degrade the quality of the toner. Both of these effects may undesirably affect the quality of the printed image.

SUMMARY

The present application relates to a system and method for reducing the wear on toner cartridges by varying the point at which the surfaces of the PC drums contact a moving transport member. In one embodiment, an image-forming device comprises one or more image forming stations, each having an associated PC drum, and transport member to move toner images or media. Each of the PC drums maintains contact with a surface of the transport member regardless of whether they are being used to form an image. A controller controls the rotation of the PC drums to rotate or not rotate while in contact with the surface of the transport member.

In one embodiment, the controller generates a control signal to rotate one or more selected PC drums to transfer a toner image. During this toner image transfer, the controller stops those PC drums not used in the image-formation process from rotating to reduce wear on the PC drum and the image forming station. Once the toner image transfer is complete, the controller indexes the stopped PC drums to change the contact point between the PC drum and the transport member to reduce wear to the PC drums.

DETAILED DESCRIPTION

The present application reduces wear on image forming stations during an image formation process by stopping the rotation of the photoconductive (PC) drums not used to transfer a toner image. While stopped, the PC drums remain in contact with the moving transport member, which may wear on the coating on the PC drum surfaces. To reduce this wear, the PC drums are indexed after the transfer of the toner image such that a different portion of the PC drum surface contacts the moving transport member.

Figure 1:
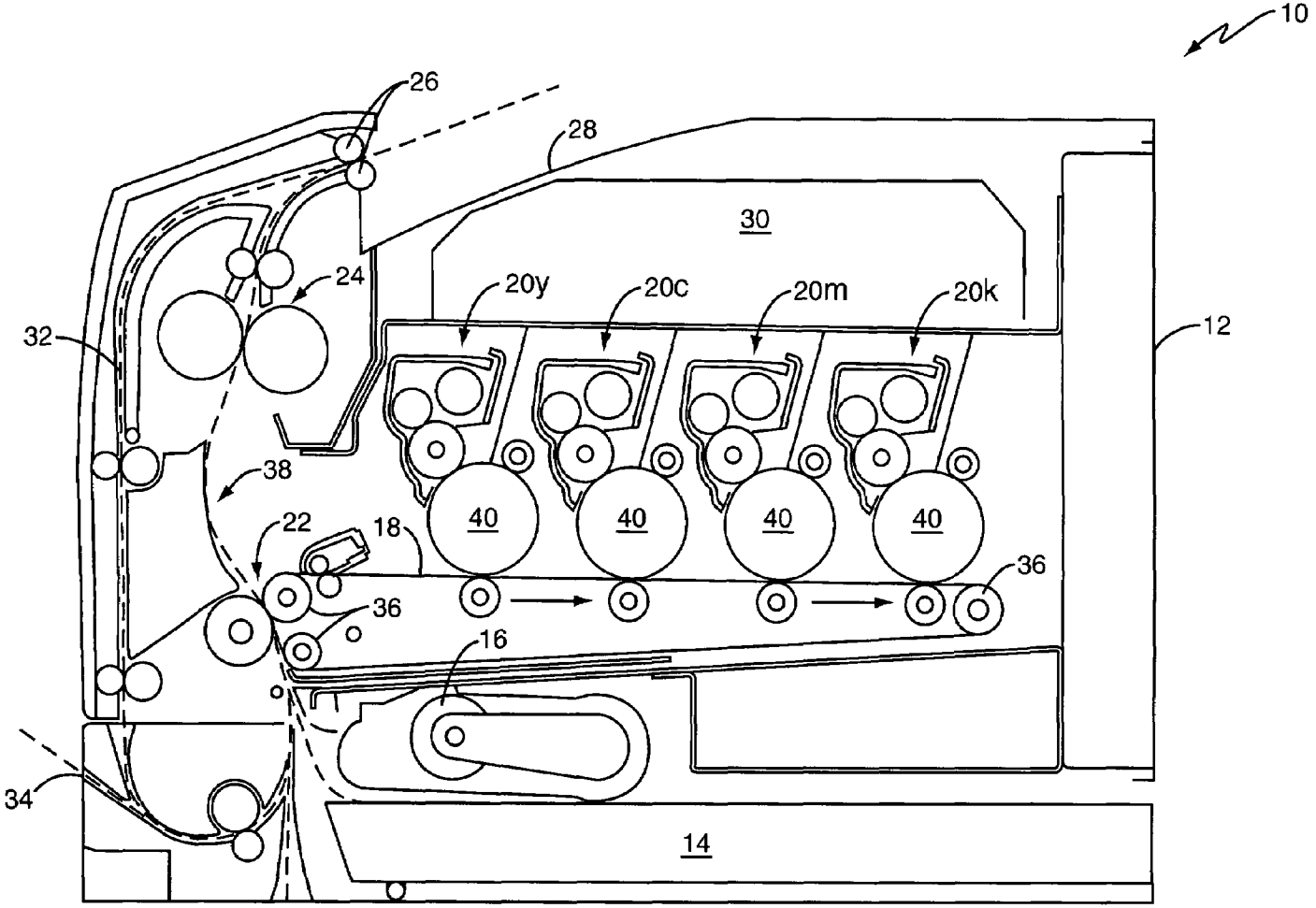
FIG. 1 illustrates a schematic view of an image-forming device configured to operate according to one embodiment.

FIG. 1 depicts a representative image-forming device, such as a printer, indicated generally by the numeral 10. Examples of the image-forming device 10 include, but are not limited to, Model Nos. C750 and C752, each available from Lexmark International, Inc. of Lexington, Ky. The image forming device 10 comprises a main body 12, at least one media tray 14, a pick mechanism 16, a transport member 18 which in this embodiment comprises an intermediate transfer member, a plurality of image forming stations 20, a second transfer area 22, a fuser area 24, exit rollers 26, an output tray 28, a printhead 30, and a duplex path 32. An auxiliary feed 34 permits a user to manually feed print media into the image-forming device 10.

In this embodiment, transport member 18 is formed as an endless belt trained about a plurality of support rollers 36. However, this is for illustrative purposes only. In other embodiments, transport member 18 is formed as a rotating drum. During image forming operations, transport member 18 moves in the direction of the arrow past a series of image forming stations 20. One or more of the image forming stations 20 apply toner images to the transport member 18. The moving transport member 18 then conveys the toner image to a media sheet at the second transfer area 22.

The media tray 14 is disposed in a lower portion of the main body 12, and contains a stack of print media. The media tray 14 is preferably removable for refilling. Pick mechanism 16 picks the print media from the top of the media stack in the media tray 14 and feeds the print media into a primary media path 38. The media is moved along the primary media path 38 and receives the toner image on the transport member 18 at the second transfer area 22.

Once the toner image is transferred, the print media is conveyed along the primary media path 38 to the fuser 24. The fuser 24 fuses the toner to the print media and conveys the print media towards the exit rollers 26. Exit rollers 26 either eject the print media to the output tray 28, or direct it into duplex path 32 for printing on a second side of the print media. In the latter case, the exit rollers 26 may partially eject the print media and then reverse direction to invert the print media and direct it into the duplex path 32. A series of rollers in the duplex path 32 return the inverted print media to the primary media path 38 upstream from the second transfer area 22 for printing on the second side.

Figure 2:
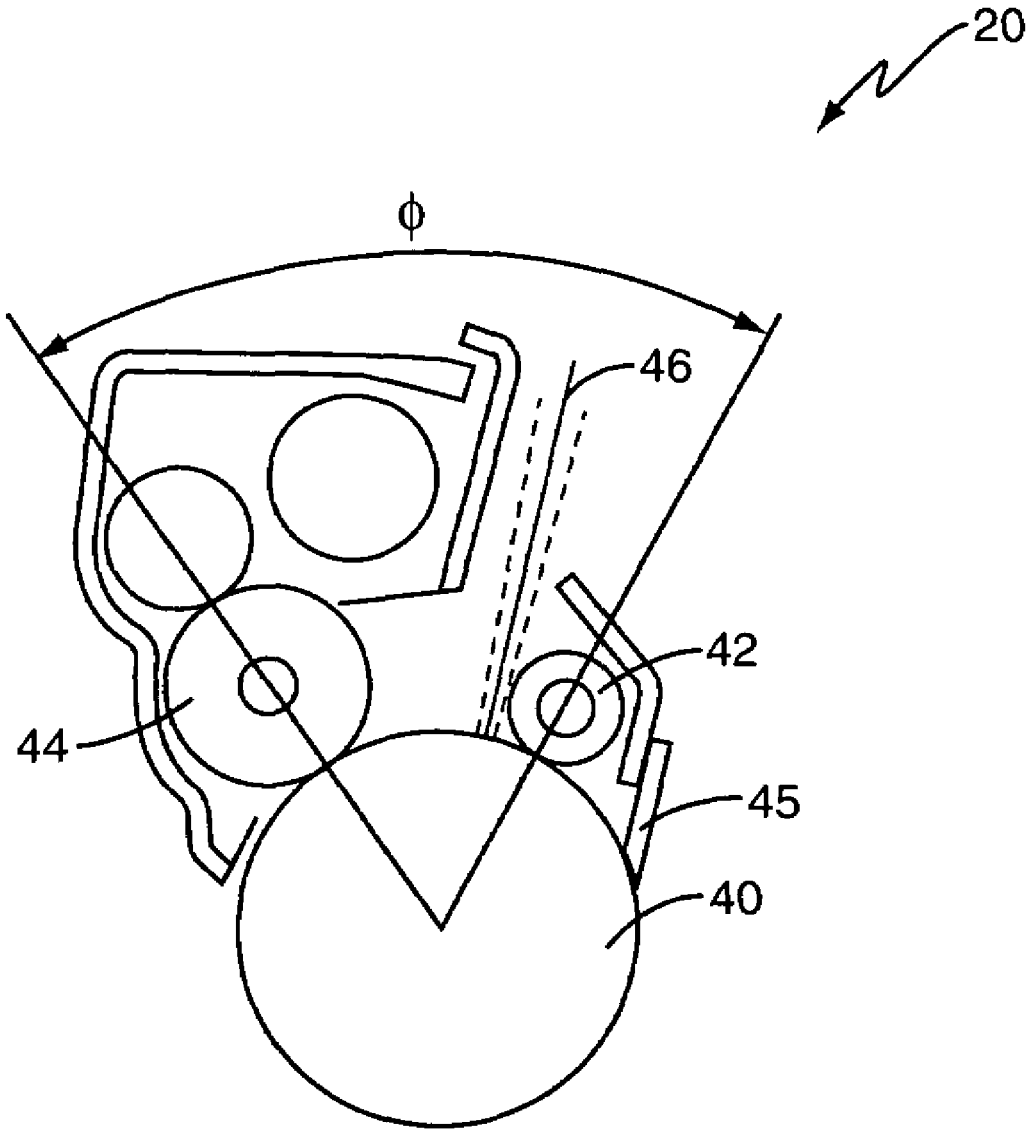
FIG. 2 illustrates a schematic view of an image-forming station suitable for use with an image-forming device according to one embodiment.

Most color image forming devices typically include four image forming stations 20 for printing with yellow 20*y*, cyan 20*c*, magenta 20*m*, and black 20*k* toner. Image forming device 10 may use two or more different toners to produce a multi-color image, and any one of the toners to produce a monochrome image. FIG. 2 illustrates a schematic view of an image forming station 20 suitable for use according to one embodiment. The image forming station depicted in FIG. 2 may represent any of the image forming stations 20 having yellow, cyan, magenta, or black toner.

The image forming station 20 in FIG. 2 includes a rotating PC drum 40, a charging member 42, a developing member 44, and a cleaning member 45. The charging member 42 forms a nip with the PC drum 40, and charges the surface of the PC drum 40 to a specified voltage such as −1000 volts, for example. A laser beam 46 from printhead 30 contacts the surface of the PC drum 40 and discharges those areas it contacts to form a latent image. In one embodiment, areas on the PC drum 40 illuminated by the laser beam 46 are discharged to approximately −300 volts. The developing member 44, which also forms a nip with the PC drum 40, then transfers negatively charged toner particles from a toner reservoir (not shown) to the PC drum 40 to form a toner image. The toner particles are attracted to the areas of the PC drum 40 surface discharged by the laser beam 46. As the PC drum 40 continues to rotate, a positive voltage field produced by transfer rollers attracts the toner image from the PC drum 40 to the surface of the moving transport member 18. As is known in the art, toner remaining on the PC drum 40 after the transfer of the toner image may be removed by the cleaning member 45.

As previously stated, PC drums of conventional image-forming devices remain in contact with the surface of the transport member 18 even when not used in the formation of a particular toner image. By way of example, the PC drums associated with the yellow, cyan, and magenta image forming stations 20*y*, 20*c*, 20*m* may not be used in the formation of a black only image (e.g., a text document). Yet, in conventional devices, these particular PC drums will continue to rotate while in contact with the transport member 18. This rotation may lead to at least two adverse effects, both of which can affect the quality of a printed image. First, this rotation continually stirs or "works" the toner within the toner reservoir, which can adversely affect the properties of the toner. Second, this rotation results in the buildup of friction between the surface of the PC drum and the cleaning member 45 that may prematurely thin a coating on the surface of the PC drum. As this coating thins, the PC drum loses its ability to charge properly. The present invention reduces this wear on the image-forming station 20 and the PC drum 40 by controlling the rotation of the PC drums 40.

Figure 3:
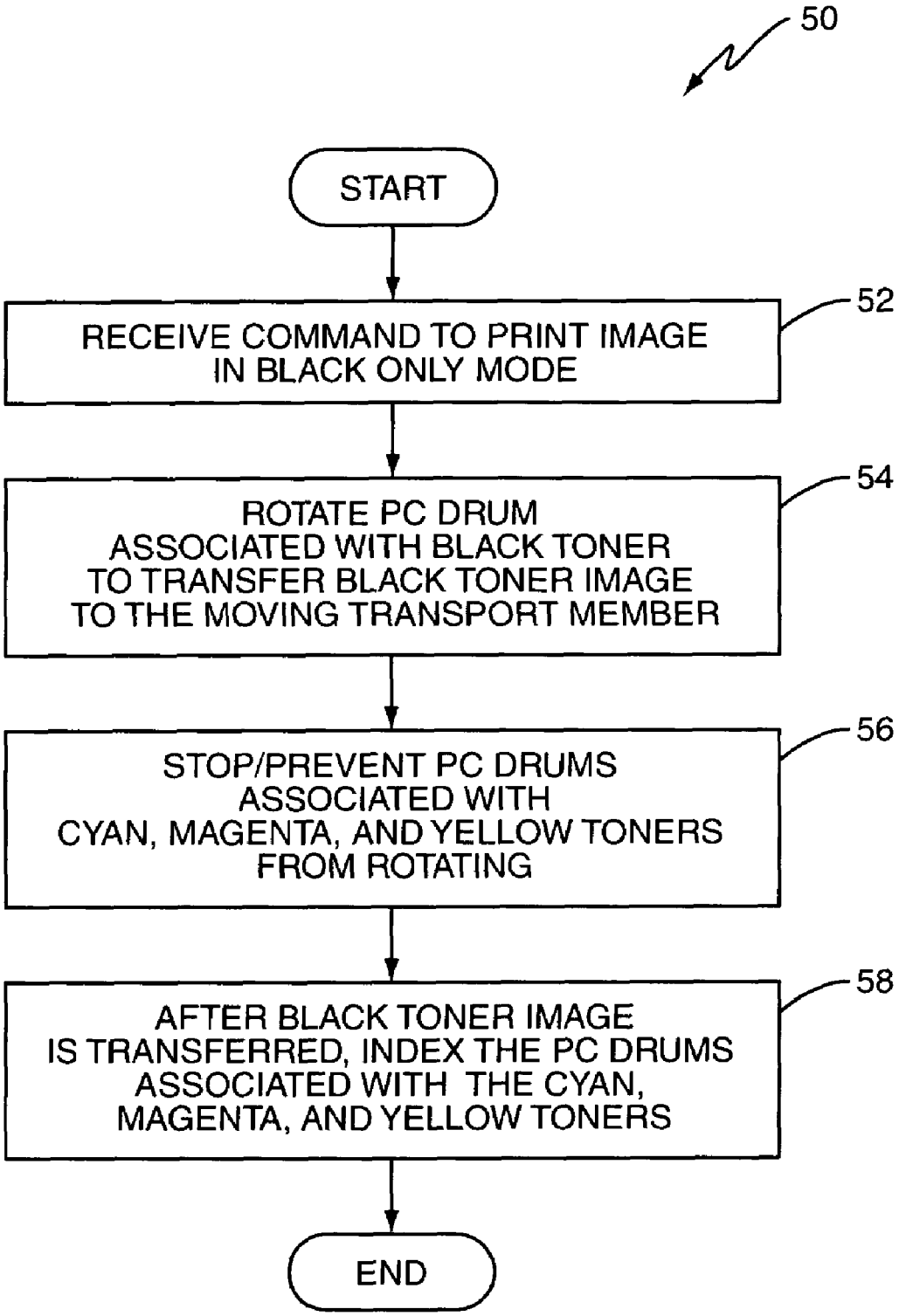
FIG. 3 is a flow chart that illustrates a method according to one embodiment.

FIG. 3 is a flow chart of one embodiment that illustrates a method 50 of controlling the rotation of one or more of the PC drums 40 to reduce wear. In method 50, the image-forming device 10 receives a command to print a black only image (box 52). The PC drum 40 associated with the image-forming station 20*k* containing the black toner is rotated to transfer a black toner image to the moving transport member 18 (box 54). The PC drums 40 of the remaining image-forming stations 20*y*, 20*c*, 20*m*, are stopped and remain in contact with the transport member during the first transfer of the black toner image (box 56).

Stopping the rotation of PC drums 40 not used in the formation of the toner image reduces the amount of time that the image-forming stations 20 are stirring their respective color toners. In addition, it reduces the amount of friction that occurs between the PC drums 40 and their respective cleaning members 45 that remove the excess toner. However, because the stopped PC drums 40 maintain contact with the moving transport member 18, the moving transport member 18 scrubs against a limited surface area of the PC drum 40. This friction between the PC drum 40 surface and the moving transport member 18 may unevenly wear the coating of the PC drum 40 surface, and thus, adversely affect the quality of the printed image. To prevent this excessive wear, the PC drums 40 associated with the unused toners are indexed after the toner image has been transferred from the PC drum 40 of the black image forming station 20*k* to the transport member 18 (box 58).

In one embodiment, indexing includes rotating each unused PC drum 40 a predetermined amount. That is, the unused PC drums 40 are rotated that presents a new surface of the PC drums 40 to the moving ITM 18. In one embodiment, each of the unused PC drums 40 is indexed substantially the same amount. In another embodiment, the unused PC drums 40 are indexed differing amounts.

In one embodiment, the angular distance extends along an arc that is greater than or less than a full 360° rotation. In one embodiment, the PC drums 40 are rotated an amount that is a non-integer fraction or non-integer multiple of 360°. Whatever the amount of rotation, however, it should cause a different portion of the PC drum 40 surface area to engage the moving transport member 18 and provide a more even wear on the PC drum 40 surface coating.

One factor to consider in determining the amount of the unused PC drum 40 rotation is the charge level on the PC drum 40 surface. Specifically, the charge on the surface of the unused PC drums 40 will decay naturally. If this charge decays to a low enough level, toner particles may be attracted to the unused PC drums 40 during indexing. Therefore, the arc through which the unused PC drums 40 are rotated is selected to maintain the charge at an appropriate level. As seen in FIG. 2, for example, the unused PC drums 40 are indexed at a predetermined frequency through an arc that is equal to or greater than an angular distance Φ between the nips formed between the PC drum 40 and the charging and developing members 42, 44. This angle may vary according to the placement of the charging and developing members 42, 44. In one specific embodiment, the angle Φ is approximately 56°.

Another factor that may be considered is determining when to index the unused PC drums. For example, an unused PC drum 40 may remain stopped and in contact with the moving transport member 18 for a predetermined time without being negatively affected by the scrubbing. The length of the predetermined time may vary; however, in one embodiment, the predetermined time is about 3 minutes. A controller or other microprocessor may track the length of time that the unused PC drums 40 are stopped and, once the predetermined time expires, rotate the unused PC drums 40 through an arc as previously described. This allows the PC drum 40 to be indexed at a predetermined frequency.

The unused PC drums 40 may be stopped from rotating during the toner image transfer to prevent the indexing process from interfering with the transfer of the toner image. Thus, during a single-page image-forming process, indexing may begin after the toner image transfer to the transport member 18 is complete, and continue until the toner image is transferred to the print media. In a multi-page image-forming process, indexing may occur during an inter-page gap. In one embodiment, this inter-page gap occurs every 3 seconds, but may be any length desired.

The previous embodiment described a black only image formation process wherein the PC drums 40 associated with the unused yellow, cyan, and magenta toners stop rotating during the toner image transfer, and undergo indexing after the black toner image is transferred to the transport member 18. However, those skilled in the art will readily appreciate that the present invention is not so limited. For example, the embodiment described above may be utilized when forming a color image from two or more different toners, or when forming a monochrome image from a single non-black toner. As above, the PC drums 40 not used in the image-formation process stop rotating during the transfer of the toner image, and are indexed after the first toner image transfer is complete to reduce wear on the image forming stations 20.

Figure 4:
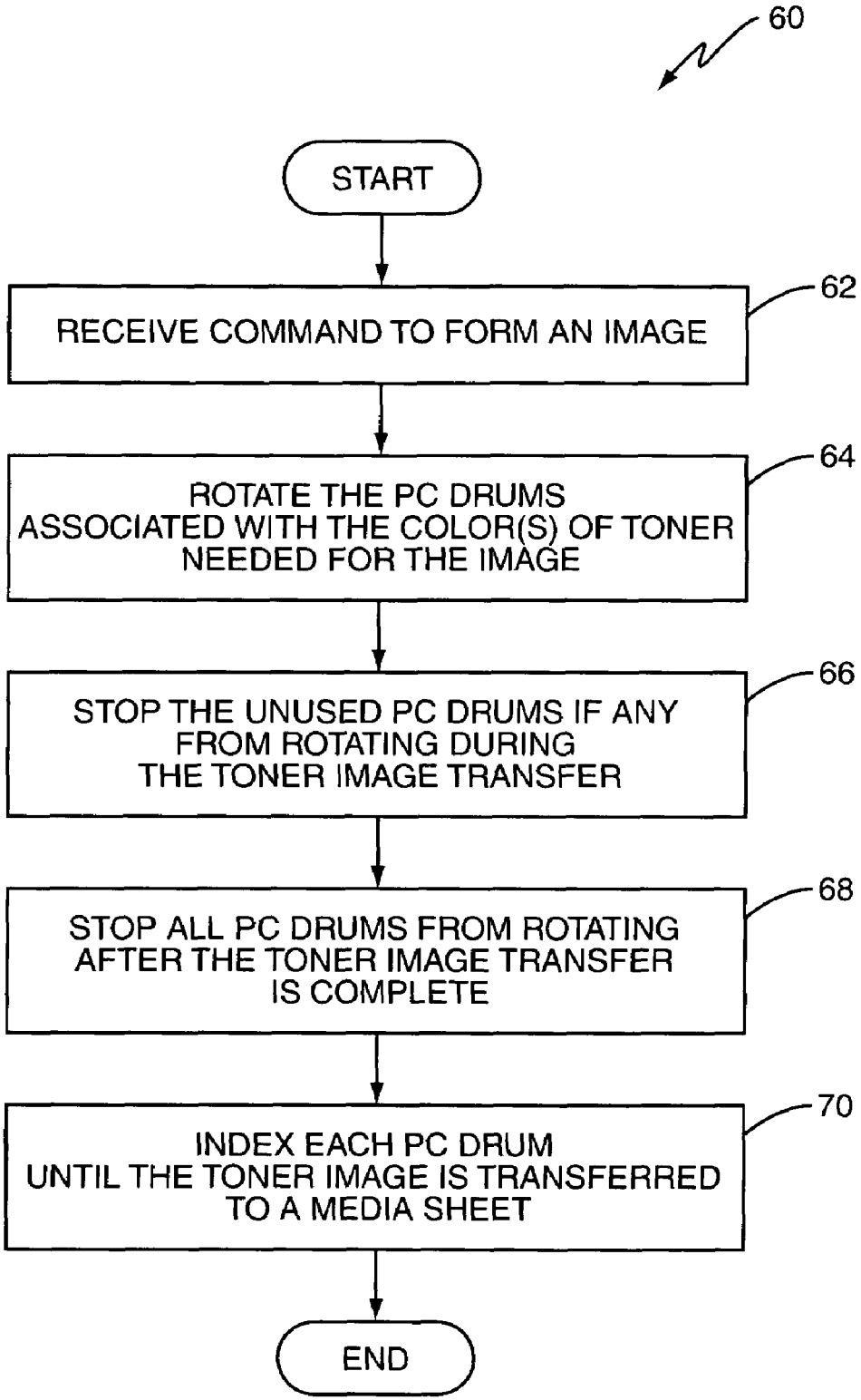
FIG. 4 is a flow chart that illustrates another method according to another embodiment.

FIG. 4 is a flow chart that illustrates a method 60 according to another embodiment wherein the PC drums 40 are indexed regardless of whether they are used in the image-forming process. Method 60 begins when the image forming device 10 receives a command to form an image on a print media (box 62). The image may be a color image that uses the toner of two or more image forming stations 20, or may be a monochrome image that uses the toner of only one of the image forming stations 20. The PC drums 40 of those image forming stations 20 used in the image formation process are then rotated to transfer their respective toner images to the moving transport member 18 (box 64). Those PC drums 40 that are not used in the image formation process, if any, are stopped during the toner image transfer (box 66). After the toner image has been transferred to the transport member 18, each of the PC drums 40 are stopped from rotating (box 68) and indexed until the toner image is transferred to the print media (box 70).

Controlling the rotation of the PC drums 40 may also occur at times other than the image-formation process. For example, transport member 18 may periodically undergo various cleaning or conditioning cycles to remove excess toner from the transport member 18, the second transfer area 22, and the like. Typically, these sorts of processes require the transport member 18 to travel about the support rollers 36. In some conventional devices, the PC drums 40 rotate while remaining in contact with the moving transport member 18. According to one embodiment, however, one or more of the PC drums 40 are stopped from rotating, and indexed during this time.

Various techniques may be used to control the rotation of the PC drums 40. One embodiment, shown in FIG. 5, employs a controller 72 communicatively connected to a pair of motors 74*a*, 74*b*. An output of each motor 74*a*, 74*b* connects by any means known in the art to a pair of the PC drums 40. The controller 72 outputs control signals to one or both of the motors 74*a*, 74*b* to turn the motors on and off. When the motors 74*a*, 74*b* are on, they drive their corresponding PC drums 40 to rotate. When the motors are off, they do not drive their corresponding PC drums 40 to rotate.

Figure 5:
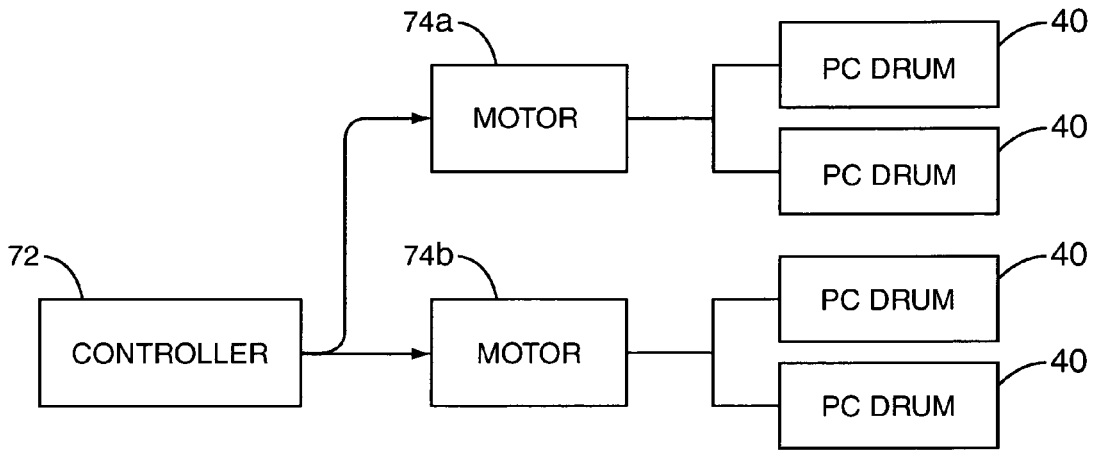
FIG. 5 is a block diagram that illustrates an embodiment that controls the rotation of photoconductive drums.

In the embodiment of FIG. 5, each motor 74*a*, 74*b* connects to and drives a pair of PC drums 40; however, this is merely for illustrative purposes. Those skilled in the art will appreciate that there may be other suitable motor-PC drum arrangements. In some embodiments, for example, each PC drum 40 is driven by its own motor 74. The controller 72 could turn each motor 74 on/off independently of the others to control the rotation of its corresponding PC drum 40. In another embodiment, a single motor 74 drives all the PC drums 40 via gears or other mechanical linkages. In these embodiments, the controller 72 could generate control signals to engage and disengage the appropriate gears or linkages to control the PC drum 40 rotation.

In one embodiment, the one or more motors 74 that drive the PC drums 40 also drive the other elements of the image forming stations 20 (e.g., charging members 42, developing members 44). Therefore, these other elements are also stopped during stopping of the PC drum 40. In one embodiment, separate motors drive the other elements and stopping the PC drum does not affect the other elements.

As previously stated, the PC drums 40 maintain contact with the moving transport member 18 while the PC drums 40 are stopped or are being indexed. However, this contact could potentially disturb a toner image moving past the PC drums 40 with the moving transport member 18. Therefore, in one embodiment, the controller 72 is configured to stop and index each PC drum 40 only after the toner image has passed downstream of that PC drum 40.

Figure 6:
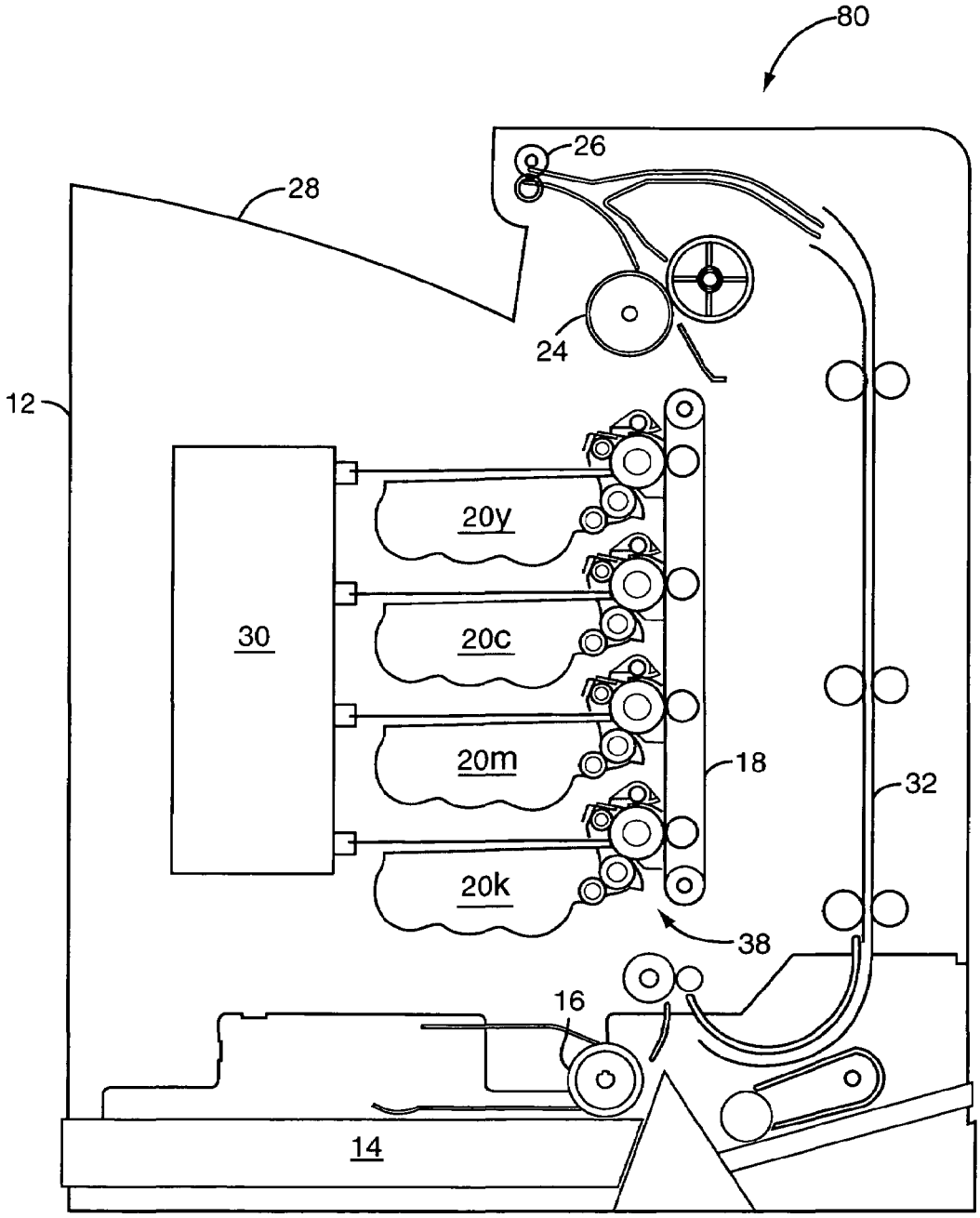
FIG. 6 illustrates a schematic view of an image-forming device configured to operate according to one embodiment.

It should be noted that the image-forming device 10 illustrated in the previous embodiments is a two-stage image-forming device. In two-stage transfer devices, the toner image is first transferred to a moving transport member 18, such as an endless belt, and then to a print media at the second transfer area 22. However, the present invention is not so limited, and may be employed in single-stage or direct transfer image-forming devices 80, such as the image-forming device shown in FIG. 6.

In such devices 80, the pick mechanism 16 picks an upper most print media from the input tray 14, and feeds it into the primary paper path 38. The transport member 18, which in this embodiment is a belt formed as an endless loop, conveys the print media past each image-forming station 20. The PC drums 40 of one or more of the image-forming stations 20 transfer their respective toner images directly to the print media. The transport member 18 continues to convey the print media having the toner image thereon to the fusing station 24 for fusing. The exit rollers 26 either eject the print media to the output tray 28, or direct it into the duplex path 32 for printing on a second side of the print media.

Further, the present application is not limited to image-forming devices 10 that employ a belt as the transport member 18. While not specifically shown in the Figures, the transport member 18 may comprise a rotating drum in either a direct transfer device or a two-stage transfer device.

The present application may be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A method of reducing wear in an image forming device comprising one or more active photoconductive drums used to transfer a toner image, and one or more inactive photoconductive drums not used to transfer the toner image, the method comprising:

controlling one or more active photoconductive drums to rotate while in contact with a moving transport member;

controlling one or more inactive photoconductive drums to stop rotating while in contact with the moving transport member; and controlling the inactive photoconductive drums to index by rotating each of the inactive photoconductive drums through an arc that is based on a position of a charging member for the inactive photoconductive drum relative to a position of a corresponding developing member while maintaining contact with the moving transport member to change a point of contact between the inactive photoconductive drums and the moving transport member.

2. The method of claim 1 wherein the inactive photoconductive drums are controlled to stop rotating while the active photoconductive drums transfer the toner image.

3. The method of claim 2 wherein the inactive photoconductive drums are controlled to index during an inter-page gap in a multi-page image formation process.

4. The method of claim 2 wherein the inactive photoconductive drums are controlled to index after the active photoconductive drums transfer the toner image in a single-page image formation process.

5. The method of claim 1 wherein the active photoconductive drums transfer a multi-color toner image.

6. The method of claim 1 wherein controlling the inactive photoconductive drums to index comprises controlling each of the inactive photoconductive drums to rotate through an arc that is approximately equal to an angular distance between its corresponding charging member and developing member.

7. The method of claim 1 wherein each inactive photoconductive drum is controlled such that stopping the rotation and indexing a given inactive photoconductive drum occurs after the toner image has moved downstream of the given inactive photoconductive drum.

8. The method of claim 1, wherein the arc has an angular distance of approximately 56 degrees.

9. The method of claim 1, wherein controlling the inactive photoconductive drums to index comprises controlling each of the inactive photoconductive drums to rotate through an arc that is greater than or equal to an angular distance between its corresponding charging member and developing member.

10. A method of reducing wear in an image forming device having a transport member and one or more image forming stations each including a corresponding photoconductive drum, the method comprising:

controlling one or more photoconductive drums to rotate while in contact with a moving transport member to transfer a toner image;

controlling each of the photoconductive drums to stop rotating while in contact with the moving transport member after the transfer of the toner image; and controlling each of the photoconductive drums to index while maintaining contact with the moving transport member to change a point of contact between each of the photoconductive drums and the moving transport member, comprising rotating each photoconductive drum through an arc that is based on a position of a charging member associated with the photoconductive drum relative to a position of a corresponding developing member.

11. The method of claim 10 further comprising controlling one or more of the photoconductive drums that are inactive during the toner image transfer to stop rotating while maintaining contact with the transport member.

12. The method of claim 10 wherein the arc is greater than or equal to an angular distance between the charging member and the developing member.

13. The method of claim 12 wherein the arc is approximately equal to an angular distance between a charging member and a developing member associated with each photoconductive drum.

14. The method of claim 12 further comprising controlling each of the photoconductive drums to stop indexing after the toner image has been transferred to a print media.

15. The method of claim 10 wherein each photoconductive drum is controlled such that stopping the rotation and indexing a given photoconductive drum occurs after the toner image has moved downstream of the given photoconductive drum.

16. The method of claim 10, wherein the controller is configured to index the photoconductive drums not used to transfer the toner image through an arc that is greater than or equal to an angular distance between their respective charging and developing members.

17. An image forming device comprising:

a moving transport member;

one or more image forming stations each comprising a rotating photoconductive drum operative to transfer a toner image and to remain in contact with the transport member; and a controller configured to:

stop a rotation of one or more photoconductive drums not used to transfer the toner image while maintaining contact with the moving transport member to reduce wear on their associated toner cartridges; and index the photoconductive drums not used to transfer the toner image by rotating through an arc having a length that is based on an angular distance between their respective charging and developing members while maintaining contact with the moving transport member to change a point of contact between the photoconductive drums and the moving transport member.

18. The image forming device of claim 17 wherein the controller is configured to index the photoconductive drums not used to transfer the toner image through an arc that is approximately equal to an angular distance between their respective charging and developing members.

19. The image forming device of claim 17 wherein the controller is configured to index the photoconductive drums not used to transfer the toner image by periodically rotating the photoconductive drums through an arc that is less than or greater than 360 degrees.

20. The image forming device of claim 19 wherein the controller is configured to rotate the photoconductive drums not used to transfer the toner image through the arc at predetermined time intervals.

21. The image forming device of claim 17 wherein the controller is configured to stop the rotation of inactive photoconductive drums not used to transfer the toner image while the toner image is transferred from one or more active photo conductive drums.

22. The image forming device of claim 21 wherein the controller is configured to index the inactive photoconductive drums during an inter-page gap during a multi-page image formation process.

23. The image forming device of claim 21 wherein the controller is configured to index the inactive photoconductive drums after the toner image is transferred in a single-page image formation process.

* * * * *